United States Patent [19]

Keeping

[11] Patent Number: 4,910,970

[45] Date of Patent: Mar. 27, 1990

[54] GLASS CHILLING CABINET

[76] Inventor: Donald Keeping, 15 Valaud Crescent, Highfield, New South Wales, Australia

[21] Appl. No.: 240,128

[22] PCT Filed: Mar. 17, 1987

[86] PCT No.: PCT/AU87/00074

§ 371 Date: Jun. 6, 1988

§ 102(e) Date: Jun. 6, 1988

[87] PCT Pub. No.: WO88/00805

PCT Pub. Date: Feb. 11, 1988

[30] Foreign Application Priority Data

Aug. 5, 1986 [AU] Australia ..... 60894/86

[51] Int. Cl.[4] ..... A47F 3/04

[52] U.S. Cl. ..... 62/250; 62/337; 62/466; 312/116

[58] Field of Search ..... 312/116, 128, 214, 306; 108/110, 144; 62/63, 78, 250, 254, 337, 378, 466

[56] References Cited

U.S. PATENT DOCUMENTS

| | | | |
|---|---|---|---|
| 608,701 | 8/1898 | Morse | 62/466 X |
| 2,457,919 | 11/1949 | Ramsey | 62/337 |
| 2,499,089 | 2/1950 | Brill et al. | 62/250 X |
| 3,043,116 | 7/1962 | Fuller | 62/337 X |
| 3,797,903 | 3/1974 | Traulsen | 312/116 |

*Primary Examiner*—Lloyd L. King

*Attorney, Agent, or Firm*—Irell & Manella

[57] ABSTRACT

Glass chilling cabinet having a bottom wall, a top wall and side walls, a number of posts adapted to keep glass baskets stacked above said bottom wall, said posts being perpendicular to said bottom wall, partition members (23) arranged in a plane that is parallel to said bottom wall and leaving above said bottom wall a gap that is not smaller than the height of a basket filled with glass, compression springs (29) placed between said bottom wall and said top wall and adapted to press a stack of baskets (33) against stop members (35) retaining said stacked baskets below said top wall, a front cabinet door, a top cabinet door, and a cool air draft inlet in one of said side walls.

5 Claims, 2 Drawing Sheets

GLASS CHILLING CABINET

This invention relates to a glass chilling cabinet and more particularly it refers to a cabinet for chilling glasses placed into the baskets customarily used to wash glasses.

In pubs, glasses are used repeatedly to serve drinks to clients and of course there is the problem of washing such glasses. Currently this is made by arranging the glasses in wire baskets that are soaked in water with soap or other detergent products and of course rinsed in clear water. The problem appears that when using the glasses to serve beer or other cold drinks, they should be chilled before serving the drink, to so satisfy the client's taste. This is made habitually by filling the glasses with iced water which is discarded before serving the drink, or else soaking the glass in a cool water basin. These are time consuming tasks for the publican, besides a possible hygienic risk when the cold water is contained in an open vessel and contacts the not always clean hands of the publican.

A feature of this invention is to provide a device that allows a number of glasses to be kept cool simultaneously and under the easy reach of the publican.

Another feature of this invention is to provide a device to chill the glasses held in the same wire baskets that are currently used to wash them. so enabling a quick operation of the serving job.

A further feature of this invention is to enable a clean and hygienic chilling of the glasses.

Still another feature of this invention is to provide means to keep an appreciable number of glasses ready to be used.

Another feature of this invention is to provide means to provide an easy way to get chilled and dry glasses.

According to this invention is provided a glass chilling cabinet for glass rinsing glasses, said cabinet having a bottom wall, a top wall and side walls, a number of posts adapted to keep baskets stacked above said bottom wall, said posts being perpendicular to said bottom wall, partition members arranged in a plan that is parallel to said bottom wall and leaving above said bottom wall a gap not smaller than the height of a basket filled with glasses, compression springs placed between said bottom wall and said top wall and adapted to press a stack of baskets against stop members adapted to retain said stacked baskets below said top wall, a front cabinet door, a top cabinet door, and an air draft inlet in one of said side walls.

A preferred embodiment of this invention will now be described in reference with the accompanying drawings wherein.

In all figures, the same reference numbers have been used for the same or similar parts.

Figure 1:
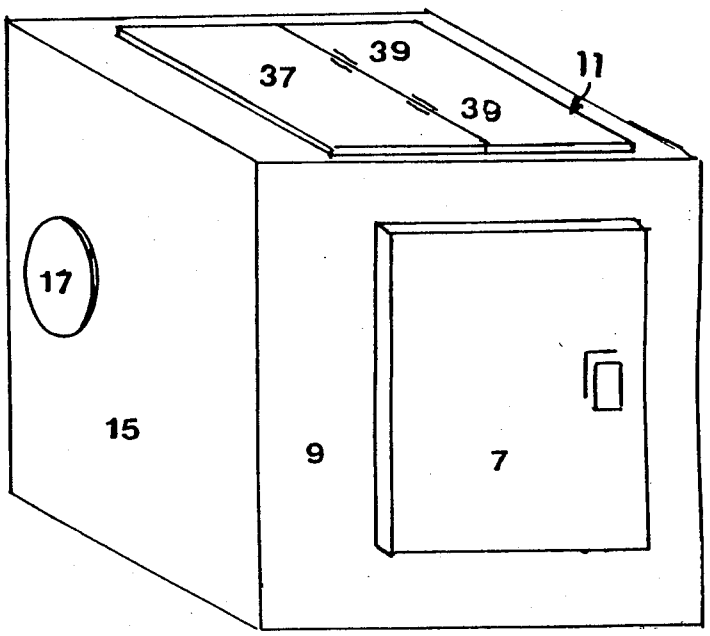
FIG. 1 is a perspective view of the cabinet according to this invention.
Figure 2:
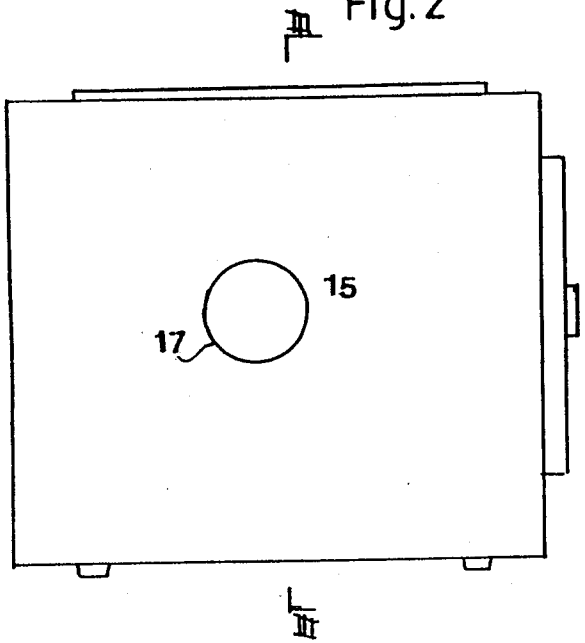
FIG. 2 is a side elevation view of the cabinet of FIG. 1.
Figure 3:
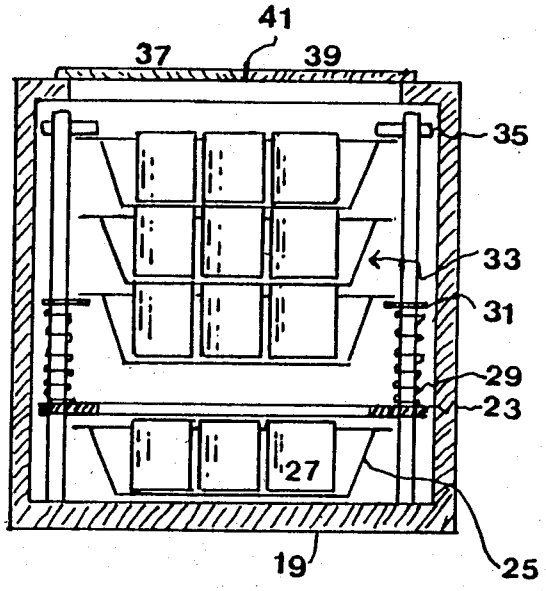
FIG. 3 is a section through III—III of FIG. 2.
Figure 4:
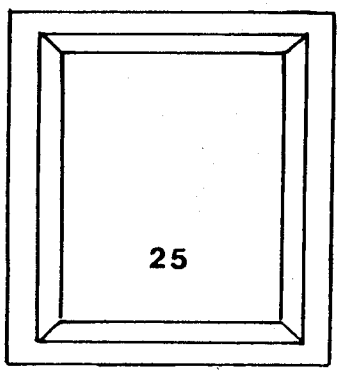
FIG. 4 is a plan view of a glass basket that may be used with said cabinet.
Figure 5:
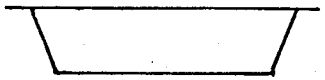
FIG. 5 is a front elevation of FIG. 4.
Figure 6:
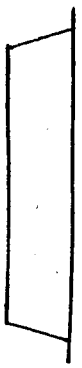
FIG. 6 is a side elevation of FIG. 4.

In reference with the accompanying drawings, the cabinet 8 according to this invention has a front door 7 at its front wall 9 and a top door 11 at its top wall. It has at its left side wall 15 a circular opening 17 with connecting members for coupling a cool-air induction conduit (not shown).

On the base 19 of the cabinet 8 are fixed the posts 21 and to said posts 21 the partition members 23 shaped like small plates rigidly secured to said post 21 and leaving between them and the base 19 a suitable space to locate one basket 25 with the glasses 27 placed as usually when said baskets are used for placement into the washing machine. So, said basket 25 may easily be put into and taken out from the cabinet through the front opening of the cabinet 8 when the door 7 is opened.

Around the posts 21 and bearing over the partition members 23 are located the helical compression springs 29 that support at their top suitable discs 31 sliding along the posts 21. On these discs 31 may be supported a stack of glass-filled baskets 33. Said stack of baskets is pushed upwards by the pressure of the springs 29 and said stack of baskets is retained by the stop members 35 secured to the posts 21. Said stop members 35 may be rotated to let the upper basket fee to be taken out through the flip top lid door that is merely placed over the upper opening of the cabinet and has two halves 37–39 articulated by hinges 41.

The inlet opening 17 is provided with suitable means for coupling to a conduit providing cool air from a refrigeration plant as used in the shop to keep cold cans or bottles. To further the refrigerating effect, a suitable rotating fan may be provided inside the cabinet or else the cool air may be supplied under the required pressure.

In the application of the cooling cabinet according to this invention, a number of baskets filled with already washed glasses is placed above the discs 31, they are retained by the stop members 35 suitably rotated and the lid 11 is shut. Then the action of the cool air provided by the refrigerating plant of the shop will keep the glasses cool. When a new supply of glasses is required by the publican, he takes a new basket through the upper door of the cabinet and sends the basket, with the glasses, to the washing machine. A new basket is placed in the upper compartment over the lower baskets, through the upper opening of the cabinet; taking it from the lower compartment under the separation 23. A further basket is taken from the washing machine and it is now put below the separation partition 23.

The claims defining the invention are as follows:

I claim:

1. Glass chilling cabinet having a bottom wall, a top wall and side walls, a number of posts adapted to keep glass baskets stacked above said bottom wall, said posts being perpendicular to said bottom wall, partition members arranged in a plane that is parallel to said bottom wall and leaving above said bottom wall a gap that is not smaller than the height of a basket filled with glass, compression springs placed between said bottom wall and said top wall and adapted to press a stack of baskets against stop members retaining said stacked baskets below said top wall, a front cabinet door, a top cabinet door, and a cool air draft inlet in one of said side walls.

2. Glass chilling cabinet as claimed in claim 1 wherein said baskets are glass rinsing baskets.

3. Glass chilling cabinet as claimed in claim 1 wherein said stop members are removable stop members.

4. Glass chilling cabinet as claimed in claim 1 wherein said cool air draft inlet is provided with means for connection with the output conduit of a refrigerating plant.

5. Glass chilling cabinet as claimed in claim 1 wherein said compression springs are helical compression springs coiled around said posts and over said partition members.

* * * * *